United States Patent [19]

Salacuse

[11] Patent Number: 4,848,573

[45] Date of Patent: Jul. 18, 1989

[54] STACKABLE PACKAGING SYSTEM

[76] Inventor: Frank S. Salacuse, 710 Park Ave., New York, N.Y. 10021

[21] Appl. No.: 89,709

[22] Filed: Aug. 26, 1987

Related U.S. Application Data

[63] Continuation of Ser. No. 867,863, May 27, 1986, abandoned.

[51] Int. Cl.[4] ..... B65D 75/00

[52] U.S. Cl. ..... 206/427; 206/486; 206/508; 206/520; 206/562; 206/563; 206/564; 206/821; 220/21

[58] Field of Search ..... 206/144, 201, 277, 390, 206/391, 394, 408, 416, 418, 421, 427, 443, 446, 477, 480, 485, 486, 490, 499, 503, 520, 562, 563, 564, 821, 508; 220/21, 23.4; 217/19, 127

[56] References Cited

U.S. PATENT DOCUMENTS

| | | | |
|---|---|---|---|
| 1,139,582 | 5/1915 | Roberts | 217/19 |
| 2,935,222 | 5/1960 | O'Connell | 217/19 |
| 3,757,982 | 9/1973 | McCarthy | 220/23.4 |
| 4,373,633 | 2/1983 | Lutz, Sr. | 206/508 |
| 4,653,651 | 3/1987 | Flum | 108/53.1 |
| 4,667,823 | 5/1987 | Wolfe, Jr. et al. | 206/821 |

FOREIGN PATENT DOCUMENTS

| | | | |
|---|---|---|---|
| 1351218 | 3/1963 | France | 206/821 |
| 154980 | 12/1967 | France | 206/821 |
| 2035277 | 6/1980 | United Kingdom | 206/508 |

*Primary Examiner*—David T. Fidei
*Attorney, Agent, or Firm*—Paul J. Sutton

[57] ABSTRACT

A stacking system for containers placed in a shipping carton. The system includes at least one layer of containers and preferably multiple layers of containers with each container of each layer held in nonmoveable relationship between upper and lower trays of identical configuration. Each tray includes a plurality of compartments spaced from one another at equal intervals adapted to receive the bottom portions of the containers and a plurality of conical recesses adapted to receive the conical tops of the containers. The compartments are formed on the top sides of the trays and the conical recesses are formed on the bottom sides of the trays. Thus each tray can be used to lock either the conical tops of each layer of containers of the bottom portions of a layer of containers. The containers are spaced apart and kept from lateral movement at both their tops and their bottoms. The edges of the trays have locking flanges to hold the trays in the cartons. The conical recesses can be located in pockets under the compartments, extend into the compartments where the bottom sides of the containers receive the conics, or can be positioned between each compartment.

15 Claims, 3 Drawing Sheets

FIG. 3
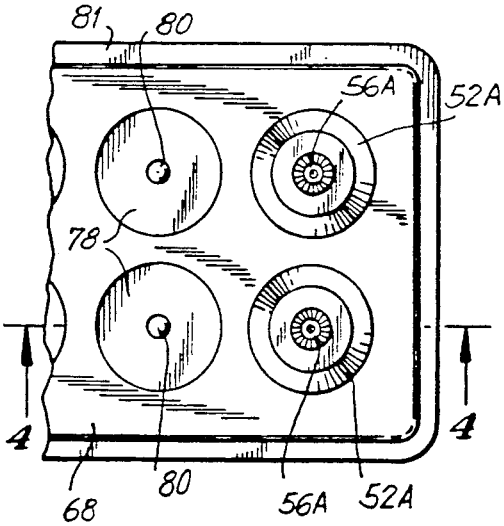
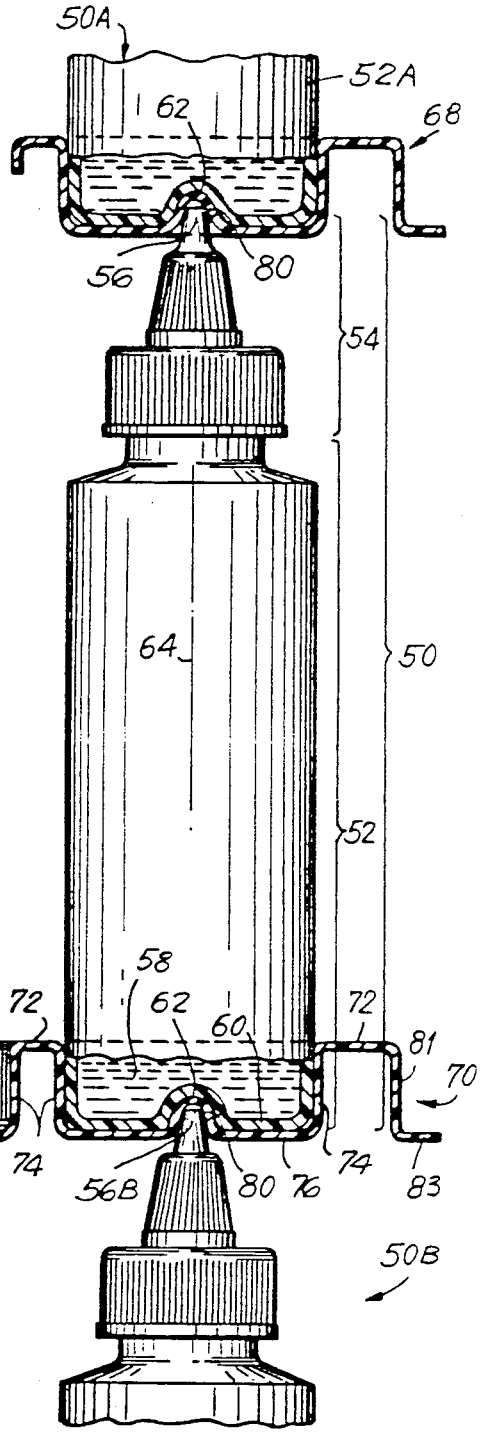
FIG. 4

STACKABLE PACKAGING SYSTEM

CROSS-REFERENCE TO RELATED APPLICATIONS

This application is a continuation of patent application Ser. No. 867,863, filed May 27, 1986, now abandoned.

FIELD OF THE INVENTION

This invention relates generally to a system for stacking containers in a carton for storage or shipment.

BACKGROUND OF THE INVENTION

Certain types of containers of product must be stacked and packaged in cartons for shipment and storage in such a way that breakage is avoided. A typical such product is glue. Such glue containers often have a top conically shaped cap that is particularly subject to breakage. If the containers of glue are simply placed in juxtaposition with one another, breakage, especially at the conical glue spout, can occur simply by interaction of the containers during handling. If this occurs, the entire contents of the package are generally lost.

SUMMARY OF THE INVENTION

It is an object of the present invention to provide a system for stacking containers having a conical top side that is economical to manufacture, efficient to assemble in a stacking position, and that holds the containers in isolation one from the other.

It is another object of the present invention to provide a system for stacking containers in preparation for packaging in a carbon that holds the containers at the top and bottom sides in spaced relationship.

In accordance with the above objects and others that will become apparent, a stacking system for containers having conical tops for packaging in a carton is provided. The system includes at least one layer of containers held in nonmoveable relationship between upper and lower trays of identical configuration. Each tray includes a plurality of compartments spaced from one another at equal intervals adapted to receive the bottom portions of the containers and a plurality of conical recesses adapted to receive the conical tops of the containers. The compartments are formed on the top sides of the trays and the conical recesses are formed on the bottom sides of the trays. Thus each tray can be used to lock either the conical tops of a layer of containers or the bottom portions of a layer of containers. The containers are spaced apart and kept from movement at both their tops and their bottoms. The edges of the trays are provided with extending locking walls which are adapted to be positioned against the inner surfaces of the walls of a carton or packing case or the like. In one embodiment the conical recesses are set in pockets formed under each compartment. In another embodiment the conical recesses extend directly upwards into the compartments with the bottom side of the containers having conical recesses adapted to receive the conics extending into the compartments. In yet another embodiment, the conical recesses for receiving the conical tops of the containers are located at equal intervals in the tray walls between the compartments.

My invention will be more clearly understood from the following description of specific embodiments of the invention together with the accompanying drawings wherein:

FIG. 3 is a top view of a second embodiment of the stacking system;

FIG. 4 is a partial side view taken through line 4—4 of FIG. 3;

DESCRIPTIONS OF THE PREFERRED EMBODIMENTS

Reference is now made in detail to the drawings wherein the same or similar elements are referred to by the same numerals throughout.

Figure 1:
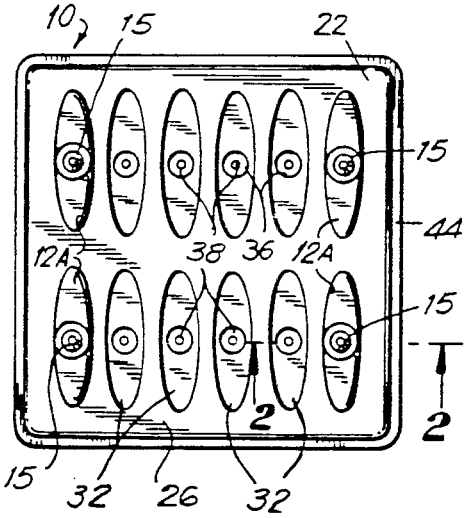
FIG. 1 is a top view of a stack of containers held in isolation from one another in one embodiment of the stacking system.
Figure 2:
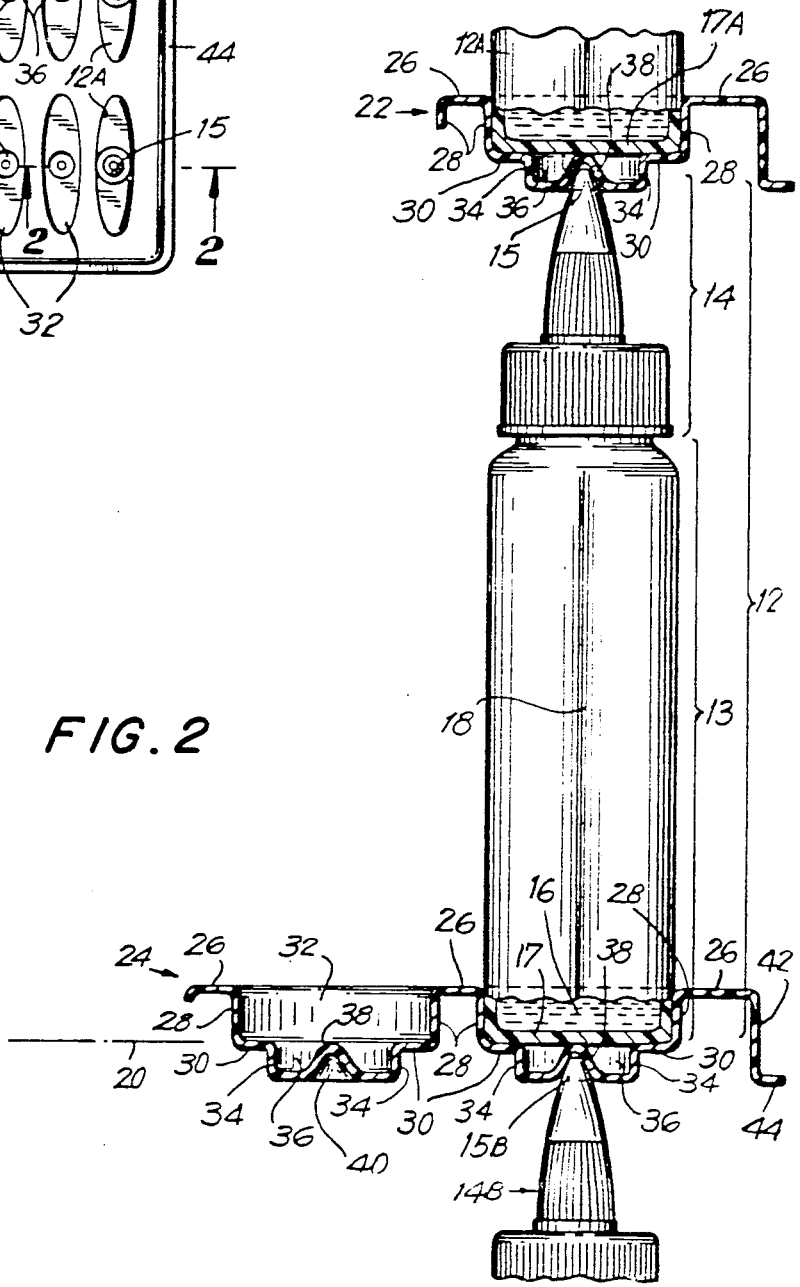
FIG. 2 is an isolated side view through line 2—2 which shows one level of stacked containers with partial views of upper and lower levels of containers shown.

A container stacking system 10 shown in top view in FIG. 1 includes layers of stacked containers 12, indicated by a top layer of containers 12A, by way of example. A full side view of one layer of containers 12 represented by one container 12 is shown in FIG. 2 with the top level of containers 12A and another layer of containers 12B shown above and below, respectively, the full-viewed container 12. Two rows of six containers in each layer are shown by way of example. Each container 12 includes a body 13 and a screw-on cap 14 having a generally conical top 15. Container 12 holds glue 16 and conical top 15 is the application nozzle for the glue. Body 13 has a flat bottom shown as bottom wall 17. Body 13 is shown in FIGS. 1 and 2 configured in horizontal cross-section in an oval configuration. The oval configuration has a geometric center (not shown) at bottom wall 16 and conical top 15 has a geometric axis 18 that is perpendicularly aligned with the geometric center of bottom wall 16. As shown in FIG. 2, the conical slope of top 15 of cap 14 is generally oblique to geometric axis 18. Bottom walls 17 of each layer are aligned along a plane here shown as a horizontal plane 20. Plane 20 can be at an orientation other than the horizontal, for example, during shipment of the containers. Containers 12 are positioned between upper and lower mounting members, or trays, 22 and 24, respectively. The view of FIG. 1 shows the very top tray over the top layer of containers 12A removed for purposes of clarity, but when the system is placed in a carton the top tray would be placed over containers 12A.

Upper and lower mounting trays 22 and 24 are identical in configuration and are interchangeable, but in the context of their relationship to each layer of containers each performs a different function as will be explained. The middle layer of containers 12 will be described as representative of every layer of containers. Each upper and lower tray 22 and 24 includes a first wall 26 that is generally parallel to and spaced above plane 20; twelve self-joined second walls 28 each oval in configuration and connected to and extending generally perpendicularly downwardly from first wall 26; and twelve third walls 30 aligned at horizontal plane 20 and connected to the lower edges of the plurality of second walls 28. Second and third walls 28 and 30 form twelve compartments 32, which are adapted to hold each of the bottom portions of bodies 13 with bottom walls 17 being adapted to be seated against third walls 30. Third walls 30 are flanged walls having inner edges. Twelve fourth walls 34 are connected to the inner edges of third walls 30 and extend perpendicularly below third walls 30 so as to define twelve pockets 36. Twelve fifth walls 38 connected to the bottom circular edges of fourth walls 34 extend first parallel to plane 20 then upwardly into pockets 36 so as to define conical recesses 40.

Compartments 32 are adapted to receive the bottom portions of body 13, in particular the bottom portions of oval side walls of containers 12 with oval bottom walls 17 being adapted to be positioned against first walls 26. Conical recesses 40 are adapted to receive conical tops 15.

Compartments 32 are adapted to hold containers 12 at their bottom portions in a first nonmoveable position relative to a parallel direction relative to plane 20 and relative to a first perpendicular direction relative to plane 20, namely, as shown in FIG. 2, the downward direction. Conical recesses 40 are adapted to hold containers 12 at conical tops 15 in a second nonmoveable position relative to the first perpendicular direction relative to plane 20 and relative to a second perpendicular direction relative to and away from plane 20 opposite to the first perpendicular direction, namely, as shown in FIG. 2, the upward direction.

First wall 26 has a rectangular edge from which depends a short side wall 42 perpendicular to first wall 26 and which extends to plane 20. A short locking wall 44 extends transversely outwardly from the bottom edge of side wall 42. The outer edge of locking wall 44 is adapted to be in contact with the inner surface of the box or carton in which the stacking system is packed in order to keep the system from moving within the carton during shipment.

FIGS. 3 and 4 show another embodiment of the invention. A container 50 shown in full view in FIG. 4 represents a middle layer of containers between top and bottom layers of containers 50A and 50B, respectively. Container 50 includes a cylindrical body 52 and a screw-on cap 54 having a conical applicator top 56 contains glue 58 and has a flat bottom wall 60 circular in top view that forms a conical recess 62 at its center. The geometric axis 64 of conical top 56 is perpendicularly aligned with the center of bottom wall 60. As shown in FIG. 4, the conical slope of top 56 of cap 54, located in conical recess 62, is generally oblique to geometric axis 64. Flat bottom walls 60 of the containers 50 positioned in the middle layer of containers is aligned with a horizontal plane 66. Plane 66 can be oriented at other angles when the stacking system has been packaged in a carton or the like. Containers 50A and 50B positioned in layers above and below, respectively, the layer represented by container 50 are aligned at their bottom walls in planes parallel to plane 66.

Container 50 is held in a nonmoveable position between upper and lower mounting trays 68 and 70, respectively. Upper and lower trays 68 and 70 are identical in configuration, but in the context of their relationship to container 50, for example, each performs a different function as will be described.

FIG. 3 shows portions of a pair of parallel rows of upper tray 68. A pair of containers are removed with two containers 50A left in place. The very top tray that would be positioned over conical tops 56 of containers 50 prior to packaging has been removed for purposes of exposition.

Each upper and lower tray 68 and 70, which are interchangeable, includes a first wall 72 that is generally parallel to and spaced above plane 66; a number of self-joined second walls 74 which are each circular in configuration and are connected to and extend generally perpendicularly downwardly from first wall 72; and a number of third walls 76 aligned at horizontal plane 66 and connected to the second walls 74. Second and third walls 74 and 76 form compartments 78, which are adapted to hold each of the bottom portions of bodies 52 with bottom walls 60 being adapted to seat against third walls 76. Conical walls 80 extending upwardly from plane 66 form conical recesses 82 that at their top surfaces are adapted to be received by conical recesses 62 of bottom walls 60 of containers 50 and at their bottom surfaces are adapted to receive conical tops 56 of containers 50.

Compartment 78 are adapted to hold containers 50 at their bottom portions in a first nonmoveable position relative to a parallel direction relative to plane 66, namely, as shown in FIG. 4, the downward direction. Conical recesses 82 are adapted to hold containers 50 at conical tops 56 in a second nonmoveable position relative to the first perpendicular direction relative to plane 66 and relative to a second perpendicular direction relative to and away from plane 66 opposite to the first perpendicular direction, namely, as shown in FIG. 4, the upward direction.

A short side wall 81 depends from the rectangular edge of first wall 82 and a short locking wall 83 aligned with plane 66 extends perpendicularly outwardly from the edge of side wall 81. The outer edge of locking wall is adapted to be in contact with the inner surface of the carton or the like into which the stack of containers is packed for shipping.

Figure 6:
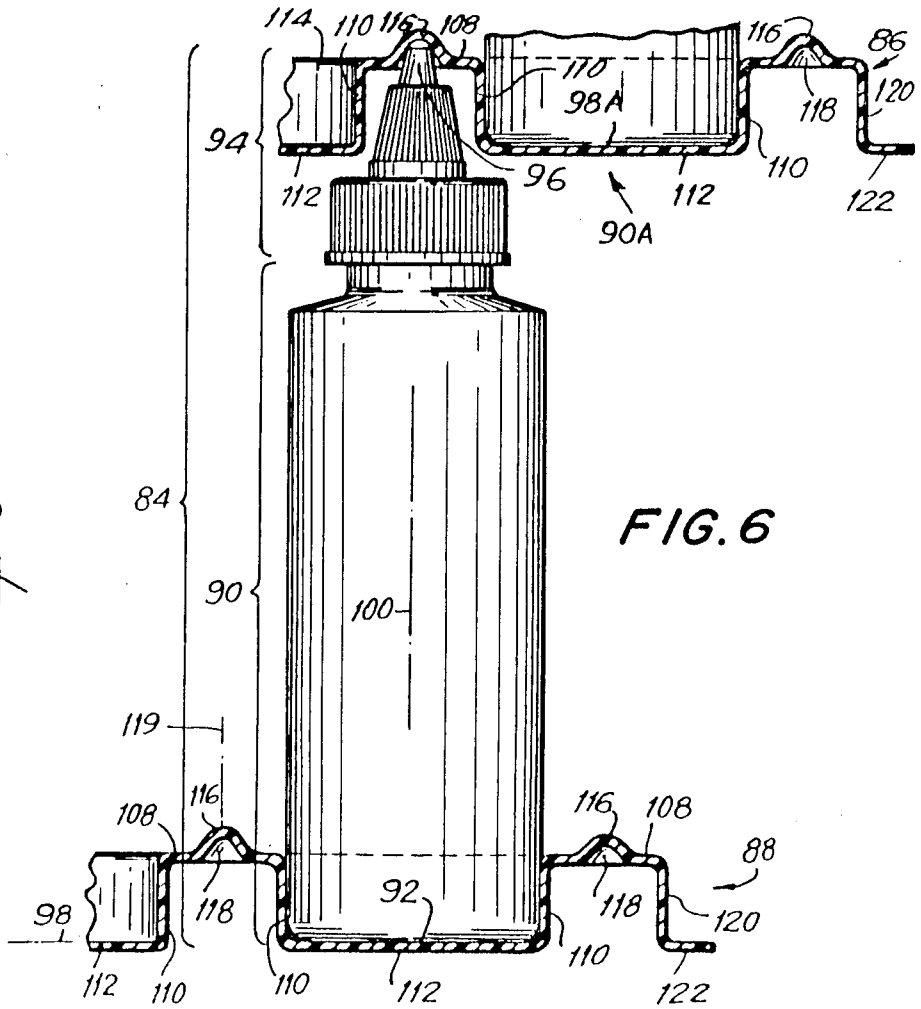
FIG. 6 is a view taken through plane 6—6 of the stacking system.
Figure 5:
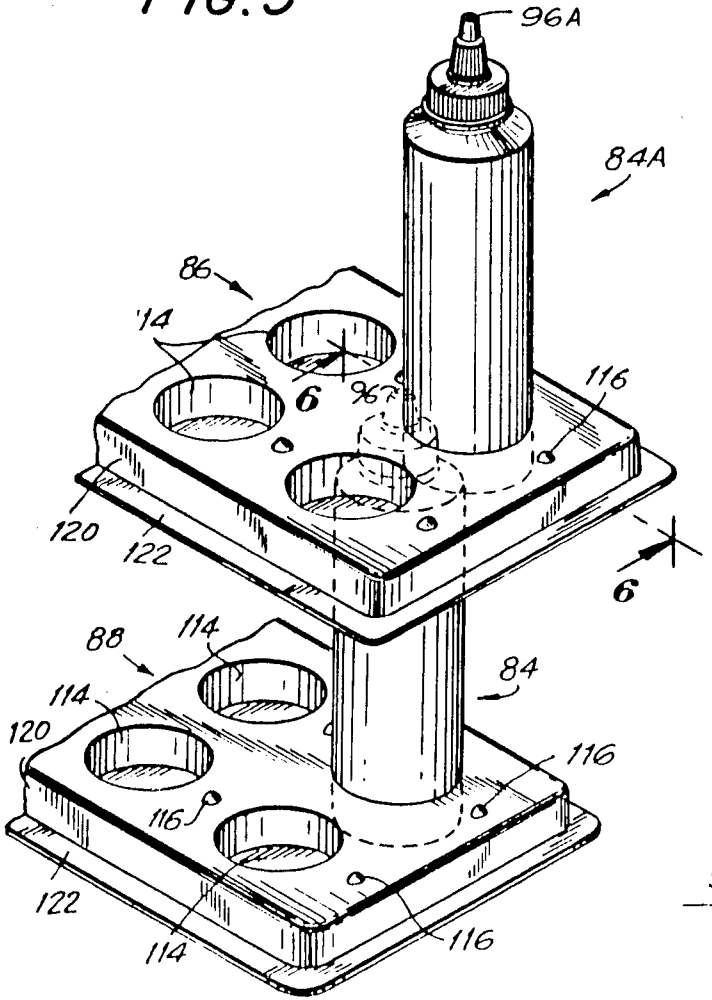
FIG. 5 is a perspective view of a third embodiment of the stacking system.

FIGS. 5 and 6 show another embodiment of the invention. A single cylindrical container 84 representative of a plurality of containers positioned in a layer between an upper mounting tray 86 and a lower mounting tray 88; and a single container 84A as representative of a layer of containers disposed over container 84 are shown in FIG. 5. Container 84 includes a cylindrical body 90 having a flat bottom wall 92 and a screw-on cap 94 having a conical top 96. Flat bottom wall 92 lies in a horizontal plane 98. Conical top 96 has a geometrical axis 100 that is perpendicular to the geometrical center of circular, flat bottom wall 92. Mounting trays 86 and 88 are identical in configuration but have different functions relative to the containers they are holding in position depending on whether the tray is above or below the layer of containers they are holding.

Each upper and lower tray 86 and 88 includes a first wall 108 that is generally parallel to and spaced above horizontal plane 98; a number of self-joined second walls 110 which are circular in configuration and are connected to and extend generally perpendicularly downwardly from first wall 108; and a number of third walls 112 aligned at horizontal plane 98 and connected to the lower edges of second walls 110. Second and third walls 110 and 112 form a number of cylindrical compartments 114, which are adapted to hold the bottom portions of bodies 90 of containers 84 with flat bottom walls 92 being adapted to be seated against the top surfaces of third walls 112. Conical walls 116 extend upwardly from third walls 110 to form a number of conical recesses 118 at equal intervals between compartments along each row of containers. Conical recesses 118 in addition have geometric axes 119 that are parallel to and equally spaced from container axes 100. FIG. 5 shows portions of two parallel rows 120 and 122 with compartments 114 spaced at equal intervals along the rows. Conical walls and conical recesses 116 and 118 are likewise spaced apart at equal intervals. Conical recesses 118 are adapted to receive conical tops 96. Containers 84 are placed in tray 86 and conical recesses 118 of upper tray are placed over conical tops 96 of the containers. This locks containers 114 into nonmoveable positions relative movements parallel to plane 66 and prevents containers 114 from moving up or down at the same time. As shown in FIG. 6, the conical recesses have a surface angle that is different from the conical surface of the cap of the container's top sides at their location of mutual contact. Trays 86 and 88 each have rectangular edges along their peripheries from which perpendicularly depend side walls 120. A short locking wall 122 extends perpendicularly outwardly from side walls 120. In this embodiment, the outer edge of locking wall 122 is adapted to be in contact with the side walls of a packing carton or the like at alternate intervals of the trays. For example, as is seen in FIG. 6, one side of locking wall 122 of tray 86 is adapted to be in contact with one wall of the carton while the aligned locking wall 122 of tray 88 would be spaced from the same wall of the carton. The opposite would be true of the other side of trays 86 and 88. Locking walls 122 of every tray would be in contact with the walls of the carton at the longitudinal dimension of the trays relative the positioning of conical recesses 118.

The embodiments and methods of the present invention particularly disclosed herein are presented merely as examples of the invention. Other embodiments, forms, modifications, and variations of the embodiments set forth here coming within the proper scope of the appended claims will, of course, readily suggest themselves to those skilled in the art.

What is claimed is:

1. A container stacking system for placement in a carton or the like, comprising, in combination:

a plurality of containers of similar configuration having opposed top and bottom sides, said bottom sides including a generally flat bottom wall having geometric centers and said top sides including caps having generally conical tops with axes generally perpendicular to said flat bottom sides at said geometric centers, at least one first mounting means for holding said containers in spaced relationship at said bottom sides in a mutual plane in a first nonmoveable position relative to a parallel direction relative to said plane and relative to a first perpendicular direction relative to said plane, and at least one second mounting means for holding said containers at said top sides in a second nonmoveable position relative to said parallel direction and relative to a second perpendicular direction away from said plane opposite to said first perpendicular direction, said first and second mounting means having the same configuration and being interchangeable with one another, each of said containers including a bottom portion including said bottom wall, and said first mounting means including a plurality of compartments adapted to hold each of said bottom portions of said plurality of containers in said first nonmoveable position, said second mounting means including a plurality of generally conical recesses for receiving said containers' top sides, said second mounting means' conical recesses comprising conical surfaces, said conical surfaces of the caps of the containers' top sides having slopes that are oblique to said perpendicular axis at their location of mutual contact with said recesses, said conical recess having a surface angle that is different from the conical surface of the cap of the containers' top sides at their location of mutual contact.

2. The container stacking system of claim 1, wherein each of said plurality of compartments has a center at said plane aligned with said geometric center of each said container, and the axis of each said conical recess is generally perpendicularly aligned with each said center.

3. The container stacking system of claim 2, wherein each said first mounting means forms a pocket adjoining each said compartment spaced in said second direction, said first mounting means further forming said conical recesses extending into said pockets.

4. The container stacking system of claim 1, wherein each said generally flat bottom side of said containers forms a conical hollow, and each said second mounting means forms said conical recess at said compartment, each said conical hollow being adapted to fit with said conical recess opposite said conical top, there being no direct contact between said containers for stack load bearing.

5. The container stacking system of claim 1, wherein said plurality of compartments are aligned in at least one row at generally equal distances, said second mounting means forming said conical recess at generally equal distances between said compartments.

6. The container stacking system of claims 5, 4, or 7, wherein said at least one first mounting means and said at least one second mounting means includes a plurality of alternating first and second mounting means, each said first and second mounting means forming both said compartments and said conical recesses, said plurality of containers being positioned in a plurality of generally parallel planes.

7. The container stacking system of claim 6, wherein each said first and second mounting means includes a mounting member having a first wall spaced from and aligned with said plane and a plurality of second walls connected to and generally perpendicular to said first wall and a plurality of third walls aligned at said plane and connected to said second wall, said second and third walls defining said compartments.

8. The container stacking system of claim 3, wherein each said first and second mounting means includes a mounting member having a first wall spaced from and aligned with said plane and a plurality of second walls connected to and generally perpendicular to said first wall and a plurality of third walls aligned at said plane and connected to said second wall, said second and third walls defining said compartments, and further including said third walls being flange walls having inner edges, said mounting member having a plurality of fourth walls connected to said flange walls at said inner edges spaced in said first direction from said flange walls, said fourth walls forming said pockets.

9. The container stacking system of claim 4, wherein said third walls of said mounting members include a plurality of fourth walls extending from said center of said compartment from said plane in said second direction, said fourth walls forming said conical recesses adapted to be received by said conical tops of said containers.

10. The container stacking system of claim 8, wherein fifth walls extend from said fourth walls into said pockets forming said conical recesses.

11. The container stacking system of claim 7, wherein said first walls of said mounting member include a plurality of fourth walls extending in said second direction, said fourth walls forming said conical recesses.

12. The container stacking system of claim 7, wherein said bottom sides of said containers are configured as ovals and said walls are also configured as ovals.

13. The container stacking system of claim 7, wherein said bottom sides of said containers are configured as circles and said second walls are also configured as circles.

14. The container stacking system of claim 1, wherein said first wall includes an edge, and further including a side wall extending generally perpendicular to said first wall extending generally to said plane.

15. The container stacking system of claim 14, wherein said side wall includes said side wall having an edge at said plane, and further including a short locking wall extending perpendicularly outwardly from said edge of said side wall, said locking wall being adapted to be positioned against the inner surface of the carton in which the stacked containers are placed.

* * * * *